US010468173B2

(12) United States Patent
Gaber

(10) Patent No.: US 10,468,173 B2
(45) Date of Patent: Nov. 5, 2019

(54) SUPPORT DEVICE OF AN ACTIVE PART OF A CURRENT TRANSFORMER

(71) Applicant: SIEMENS AKTIENGESELLSCHAFT, Munich (DE)

(72) Inventor: Michael Gaber, Weichendorf (DE)

(73) Assignee: Siemens Aktiengesellschaft, Munich (DE)

( * ) Notice: Subject to any disclaimer, the term of this patent is extended or adjusted under 35 U.S.C. 154(b) by 74 days.

(21) Appl. No.: 15/317,305

(22) PCT Filed: May 21, 2015

(86) PCT No.: PCT/EP2015/061196
§ 371 (c)(1),
(2) Date: Dec. 8, 2016

(87) PCT Pub. No.: WO2015/189018
PCT Pub. Date: Dec. 17, 2015

(65) Prior Publication Data

US 2017/0117080 A1 Apr. 27, 2017

(30) Foreign Application Priority Data

Jun. 13, 2014 (EP) ..... 14172358

(51) Int. Cl.

| | |
|---|---|
| ***H01F 27/06*** | (2006.01) |
| ***H01F 27/00*** | (2006.01) |
| ***H01F 38/30*** | (2006.01) |
| ***H01F 27/02*** | (2006.01) |

(52) U.S. Cl.
CPC ..... *H01F 27/002* (2013.01); *H01F 27/02* (2013.01); *H01F 27/06* (2013.01); *H01F 38/30* (2013.01)

(58) Field of Classification Search
CPC ..... H01F 27/002; H01F 27/02
USPC ..... 336/90, 92, 96, 107, 173, 174, 175
See application file for complete search history.

(56) References Cited

U.S. PATENT DOCUMENTS

| | | | | |
|---|---|---|---|---|
| 2,858,356 A * | 10/1958 | Setchell | ..... | H01F 27/02 174/50.54 |
| 3,456,220 A * | 7/1969 | Stewart | ..... | H01F 38/30 336/174 |
| 3,644,858 A * | 2/1972 | Galloway | ..... | H01F 27/02 336/92 |

(Continued)

FOREIGN PATENT DOCUMENTS

| | | |
|---|---|---|
| CN | 86107816 A | 6/1987 |
| CN | 101388285 A | 3/2009 |

(Continued)

*Primary Examiner* — Tszfung J Chan
(74) *Attorney, Agent, or Firm* — Laurence Greenberg; Werner Stemer; Ralph Locher

(57) ABSTRACT

A support device of an active part of a current transformer includes a plurality of insulating support legs which are composed of an electrically insulating material and which are constructed to carry the active part and to be supported on a housing base of a housing of the current transformer. A longitudinal axis of each insulating support leg forms a non-zero support angle with the direction of gravitational force or the vertical. A current transformer including a housing, an active part disposed in the housing and the support device for supporting the active part, is also provided.

8 Claims, 1 Drawing Sheet

(56) References Cited

U.S. PATENT DOCUMENTS

| | | | | |
|---|---|---|---|---|
| 4,449,110 | A | 5/1984 | Duchene | |
| 4,701,738 | A * | 10/1987 | Preissinger | H01F 38/30<br>336/107 |
| 4,744,138 | A | 5/1988 | Preissinger et al. | |
| 2008/0196920 | A1 * | 8/2008 | Findeisen | H01F 27/14<br>174/50.5 |

FOREIGN PATENT DOCUMENTS

| | | | | |
|---|---|---|---|---|
| CN | 201673803 | U | 12/2010 | |
| DE | 3540547 | A1 | 5/1987 | |
| DE | 3644553 | A1 * | 7/1988 | H01F 38/30 |
| JP | H04127628 | U | 11/1992 | |
| SU | 175561 | A | 11/1963 | |

* cited by examiner

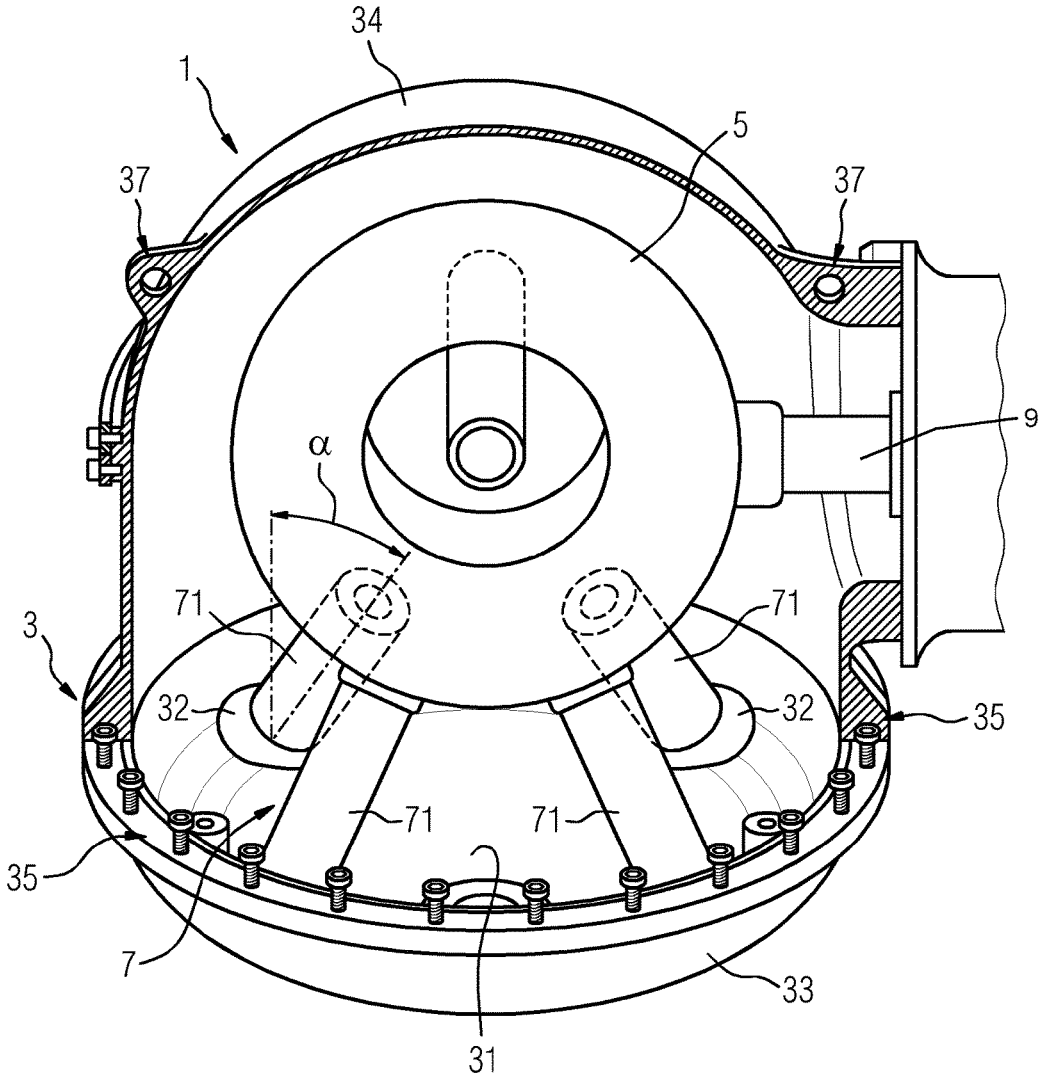
34
1
5
37
37
9
α
71
71
3
32
32
35
71
71
35
7
33
31

SUPPORT DEVICE OF AN ACTIVE PART OF A CURRENT TRANSFORMER

BACKGROUND OF THE INVENTION

Field of the Invention

The invention relates to a support device of an active part of a current transformer, and to a current transformer.

Active parts of current transformers are generally supported, depending on their weight, by two or four insulating supports which take on the weight and the mechanical loads of the active part. The installation position is either suspended or upright depending on the model.

BRIEF SUMMARY OF THE INVENTION

The invention is based on the object of specifying an improved support device of an active part of a current transformer, and an improved current transformer.

According to the invention, the object is achieved by virtue of the features of the support device, and by virtue of the features of the current transformer described below.

Advantageous refinements of the invention are the subject matter of the dependent claims.

A support device according to the invention of an active part of a current transformer comprises a plurality of insulating support legs which are composed of an electrically insulating material and which are designed to carry the active part and to be supported on a housing base of a housing of the current transformer, wherein a longitudinal axis of each insulating support leg forms a non-zero support angle with the direction of gravitational force.

In this case, the support angles are preferably selected in such a way that the insulating support legs absorb horizontal and/or lateral accelerations of the current transformer during transportation of the current transformer. As a result, the current transformer is advantageously protected against transportation damage which can be caused by accelerations of this kind.

One refinement of the invention provides that the housing base-side ends of in each case two insulating support legs are at a greater distance from one another than the active part-side ends of these insulating support legs.

As a result, the insulating support legs spread apart from the active part to the housing base, so that they can particularly advantageously absorb horizontal and/or lateral accelerations of the current transformer.

A further refinement of the invention provides precisely four insulating support legs.

This allows the active part to be supported in a particularly stable manner.

A current transformer according to the invention comprises a housing, an active part which is arranged in the housing, and a support device according to the invention for supporting the active part having the advantages already described above.

A holding means for fixing the insulating support leg on the housing base side is preferably arranged on the housing base for each insulating support leg. As a result, the insulating support legs are advantageously fastened in the housing, in particular for transportation of the current transformer.

Furthermore, the housing preferably has a housing lower part comprising the housing base and has a housing upper part, wherein the housing lower part and the housing upper part can be connected to one another in a detachable manner.

This design of the housing advantageously facilitates mounting of the active part and of the support device in the housing.

The properties, features and advantages of this invention which are described above and also the way in which they are achieved will become clearer and more distinctly comprehensible in connection with the following description of exemplary embodiments which will be explained in more detail in conjunction with a drawing.

BRIEF DESCRIPTION OF THE DRAWING

The figure of the drawing is a fragmentary, diagrammatic, perspective view of a current transformer according to the invention.

In the drawing, the single figure shows a perspective illustration of a current transformer 1 comprising a housing 3, an active part 5 which is arranged in the housing 3, a lead tube 9 and a support device 7 for supporting the active part 5 in the housing 3, wherein the housing 3 is illustrated such that it is cut open on one side in the figure.

DESCRIPTION OF THE INVENTION

The support device 7 comprises four insulating support legs 71 which are composed of an electrically insulating material, which carry the active part 5 and which are supported on a housing base 31 of the housing 3. In this case, the insulating support legs 71 spread apart from the active part 5 to the housing base 31, so that a longitudinal axis of each insulating support leg 71 forms a non-zero support angle a with the direction of gravitational force, and the housing base-side ends of in each case two insulating support legs 71 are at a greater distance from one another than the active part-side ends of these insulating support legs 71. In alternative exemplary embodiments, the support device 7 can have a different number of insulating support legs 71, for example three or five insulating support legs 71.

Furthermore, a holding means 32 for fixing the insulating support leg 71 to the housing base, for example by means of screw connections, is arranged on the housing base 31.

The housing 3 has a housing lower part 33 comprising the housing base 31 and has a housing upper part 34, wherein the housing lower part 33 and the housing upper part 34 can be connected to one another in a detachable manner by means of a flange connection 35.

The housing upper part 34 is of dome-like design and illustrated in section in the FIGURE. Two lifting lugs 37 for lifting the housing upper part 34 and the current transformer 1 are arranged on the top side of the housing upper part 34.

Although the invention has been illustrated and described in more detail by means of preferred exemplary embodiments, the invention is not restricted by the disclosed examples and other variations can be derived therefrom by a person skilled in the art without departing from the scope of protection of the invention.

The invention claimed is:

1. A support device of an active part of a current transformer, the support device comprising:

a plurality of insulating support legs composed of an electrically insulating material;

said insulating support legs being constructed to carry the active part and to be supported on a housing base of a housing of the current transformer; and each of said insulating support legs having a longitudinal axis forming a non-zero support angle with the direction of gravitational force, said support angles being selected to permit said insulating support legs to absorb at least one of horizontal or lateral accelerations of the current transformer during transportation of the current transformer, and said insulating support legs being mirror-symmetrical to a lifting direction defined by lifting lugs of the current transformer.

2. The support device according to claim 1, wherein:

said insulating support legs each have a base-side end facing the housing base and an active part-side end facing the active part; and said base-side ends of each two of said insulating support legs are at a greater distance from one another than said active part-side ends of said two insulating support legs.

3. The support device according to claim 1, wherein said plurality of insulating support legs includes precisely four insulating support legs.

4. The support device according to claim 1, wherein the lifting direction is perpendicular to a lead tube of the current transformer.

5. A current transformer, comprising:

a housing having a housing base and lifting lugs defining a lifting direction of the current transformer;

an active part disposed in said housing; and a support device for supporting said active part;

said support device including a plurality of insulating support legs composed of an electrically insulating material, said insulating support legs being constructed to carry the active part and to be supported on said housing base, each of said insulating support legs having a longitudinal axis forming a non-zero support angle with the direction of gravitational force, said insulating support angles being selected to permit said insulating support legs to absorb at least one of horizontal or lateral accelerations of the current transformer during transportation of the current transformer, and said insulating support legs being mirror-symmetrical to said lifting direction.

6. The current transformer according to claim 5, wherein said insulating support legs each have a housing base side, holding devices are disposed on said housing base, and each of said holding devices fix said housing base side of a respective one of said insulating support legs to said housing base.

7. The current transformer according to claim 5, wherein said housing has a lower housing part including said housing base and an upper housing part, and said lower housing part and said upper housing part are configured to be detachably interconnected.

8. The current transformer according to claim 5, which further comprises a lead tube, said lifting direction being perpendicular to said lead tube.

* * * * *